US009574392B2

(12) United States Patent
Alexander

(10) Patent No.: US 9,574,392 B2
(45) Date of Patent: Feb. 21, 2017

(54) RETENTION SYSTEM FOR LOUVRE BLADES

(75) Inventor: Edwin John Alexander, Whiteside (AU)

(73) Assignee: Breezway Australia (Holdings) Pty Ltd, Coorparoo, Queensland (AU)

( * ) Notice: Subject to any disclaimer, the term of this patent is extended or adjusted under 35 U.S.C. 154(b) by 0 days.

(21) Appl. No.: 13/580,415

(22) PCT Filed: Feb. 16, 2011

(86) PCT No.: PCT/AU2011/000161

§ 371 (c)(1),
(2), (4) Date: Sep. 14, 2012

(87) PCT Pub. No.: WO2011/100790

PCT Pub. Date: Aug. 25, 2011

(65) Prior Publication Data

US 2013/0000201 A1 Jan. 3, 2013

(30) Foreign Application Priority Data

Feb. 22, 2010 (AU) ..... 2010900749

(51) Int. Cl.
*E06B 7/084* (2006.01)

(52) U.S. Cl.
CPC ..... *E06B 7/084* (2013.01)

(58) Field of Classification Search
USPC ..... 49/403, 74.1; 24/289, 297
See application file for complete search history.

(56) References Cited

U.S. PATENT DOCUMENTS

| | | | | |
|---|---|---|---|---|
| 3,281,113 | A * | 10/1966 | Ahern | 251/308 |
| 4,214,622 | A * | 7/1980 | Debs | 160/168.1 R |
| 5,548,925 | A * | 8/1996 | Marocco | 49/74.1 |
| 5,794,380 | A * | 8/1998 | Guardia | 49/74.1 |
| 6,314,680 | B1 * | 11/2001 | Buckwalter et al. | 49/82.1 |
| 6,321,821 | B1 * | 11/2001 | Wunsche | 160/178.1 V |
| 6,324,731 | B1 * | 12/2001 | Pliml, Jr. | 24/453 |

(Continued)

FOREIGN PATENT DOCUMENTS

| | | |
|---|---|---|
| AU | 2007231735 A1 | 5/2008 |
| GB | 2004363 A | 3/1979 |
| WO | 2010015941 A2 | 2/2010 |

OTHER PUBLICATIONS

International Preliminary Report on Patentability; International Application No. PCT/AU2011/00161; International Application Filing Date Feb. 16, 2011; Report Issued Aug. 28, 2012.

(Continued)

*Primary Examiner* — Katherine Mitchell
*Assistant Examiner* — Shiref Mekhaeil
(74) *Attorney, Agent, or Firm* — Stoel Rives LLP

(57) ABSTRACT

A louvre blade retention system for use in a louvre windows system, the retention system including a louvre end clip mounted relative to a louvre channel, the louvre end clip having at least one longitudinal recess therein to receive an end portion of a louvre blade and at least one transverse opening, a louvre blade having at least one opening therethrough in the end portion and a retaining member adapted to be received through the aligned at least one transverse opening in the louvre end clip and the at least one opening through the louvre blade in order to fix the louvre blade to the end clip.

18 Claims, 2 Drawing Sheets

(56) References Cited

U.S. PATENT DOCUMENTS

| | | | | |
|---|---|---|---|---|
| 6,665,914 | B2 * | 12/2003 | Ogawa | 24/297 |
| 7,222,456 | B1 * | 5/2007 | Carey | 49/73.1 |
| 7,231,696 | B2 * | 6/2007 | Asano et al. | 24/297 |
| 7,552,516 | B2 * | 6/2009 | Okada et al. | 24/297 |
| 7,963,071 | B2 * | 6/2011 | Alexander et al. | 49/403 |
| 8,056,193 | B2 * | 11/2011 | Park | 24/297 |
| 2003/0101653 | A1 * | 6/2003 | Biro | 49/74.1 |
| 2005/0103451 | A1 * | 5/2005 | Nien | 160/173 R |
| 2010/0122492 | A1 * | 5/2010 | Morris et al. | 49/89.1 |
| 2012/0272487 | A1 * | 11/2012 | Cooley et al. | 24/289 |

OTHER PUBLICATIONS

International Search Report; International Application No. PCT/AU2011/00161; International Application Filing Date Feb. 16, 2011; Mail date Mar. 9, 2011.

* cited by examiner

RETENTION SYSTEM FOR LOUVRE BLADES

FIELD OF THE INVENTION

The present invention relates to louvre windows and in particularly to a system for retaining louvre blades in the louvre window.

BACKGROUND ART

In simple terms, louvre windows generally consist of a frame containing an operating mechanism in one jamb, a number of louvre blade holding clips, and a number of louvre blades. A louvre window is generally called a "jalousie" in the United States.

The louvre blades are usually rectangular in shape and have two surfaces, longitudinal top and bottom edges and opposed end edges. The blades are typically made of glass but can also be made from timber, plastic, metal and the like. It is known in the art for the longitudinal edges of adjacent blades to overlap each other for weather resistance and security when the window is in the closed state. Typically, a louvre window will have a blade width of 152 mm and a blade pitch of 140 mm, hence having a blade overlap or 12 mm. The known art is illustrated in FIG. 1 with the conventional louvre blade illustrated in FIG. 3.

The opposed end edges of the louvre a blade fit into slots provided in the blade holder clips, which can be made from metal or plastic. When a louvre window is in the closed position, it should be able to prevent wind-driven rain from passing freely between the louvre blades and give protection from forced entry.

When a force is applied to the longitudinal top or bottom edges of the louvre blade, the louvre blade can be dislodged from the blade holder clip and the blade can be removed from the window. This can occur more easily when the window is in the open position and the louvre blade is subject to an impact.

Blade retention typically depends on short L-shaped projections from the blade holder clip at both ends of the slot. To allow the blade to be assembled into the blade holder slot, these projections are typically relatively flexible which in turn limits the resistance force which they can apply against the louvre blade in order to prevent dislodgement of the blade from the blade holder clips.

It will be clearly understood that, if a prior art publication is referred to herein, this reference does not constitute an admission that the publication forms part of the common general knowledge in the art in Australia or in any other country.

SUMMARY OF THE INVENTION

The present invention is directed to a retention system for louvre blades, which may at least partially overcome at least one of the abovementioned disadvantages or provide the consumer with a useful or commercial choice.

With the foregoing in view, the present invention in one form, resides broadly in a louvre blade retention system for use in a louvre window system, the retention system including a louvre end clip mounted relative to a louvre channel, the louvre end clip having at least one longitudinal recess therein to receive an end portion of a louvre blade and at least one transverse opening, a louvre blade having at least one opening therethrough in the end portion and a retaining member adapted to be received through the aligned at least one transverse opening in the louvre end clip and the at least one opening through the louvre blade in order to fix the louvre blade to the end clip.

In an alternative form, the invention resides in a louvre blade for use in a louvre window system, the louvre blade having a pair of planar surfaces and at least one opening adjacent each end edge and extending through the louvre blade from one planar surface to the other.

The louvre window system may have any configuration. The louvre window system may have fixed louvre blades or movable louvre blades. Therefore, the retention system of the present invention may be used for dividers or screens in which the blades are fixed relative to one another. Movable louvre blades tend to be used more on window closures.

The louvre blades may be oriented in any direction and further, the blades may be mounted substantially vertically or horizontally.

The louvre blade itself may be manufactured from any material. The louvre blade may have any cross-sectional shape including substantially rectangular or foil shaped but the shape is not limited to either of these. Further, the louvre blade may be solid or hollow.

There will preferably be an opening in the louvre blade adjacent each end edge. Typically, the opening is spaced from the end edge. Each opening will typically be provided in a portion or region which is closer to the end edge of the louvre blade than the height of the recess in the end clip.

Generally, each opening will be provided approximately centrally across the louvre the height or width for pivoting louvres which typically pivot around a central point. Other types of louvres are available and these may have the opening in different locations, for example at an upper portion or along an upper region adjacent an upper edge of the louvre.

There will typically be at least one opening adjacent each edge but more than one opening may be provided spaced over the length of the edge.

In a most preferred form where the louvres pivot about a central point, one opening will be provided approximately midway across the height of each end of each louvre blade.

The opening may have any shape but may preferably be a circular opening. A slot opening may be provided as this provides flexibility in position when attaching a louvre blade to the end clip. Where a slot opening is provided, the slot typically extends with a longer dimension parallel to the height of the louvre blade or substantially parallel to the end edge. The slot opening preferably extends to the end edge of the louvre blade.

Further, the opening may taper in dimension from one side of the louvre blade to the other, but will preferably be the same dimension through the blade.

Each end clip will normally be located "inside" the louvre window frame which is normally defined by a louvre channel on each side, together with a head member and a foot or sill member.

Each end clip normally rotates relative to the louvre channel.

Each end clip normally has a pair of outer walls which each extend over the length or height of the clip. The outer walls extend from adjacent the channel member towards the centre of the louvre blade, normally also extending inwardly towards the centre line of the louvre assembly. The outer end edges of the respective outer walls are very slightly spaced from the louvre channel when in the closed condition. There is normally one outer wall on the outside of the louvre window assembly and one on the inside of the louvre window assembly. Other configurations of louvre end clip may be provided.

The outer walls may have any cross-sectional shape but will preferably be arcuate, mainly for aesthetic purposes.

Each louvre end clip is located relative to the channel member forming the louvre window frame. Each louvre channel member is normally substantially U-shaped in cross-section.

The end clips each have a recess formed between the respective outer walls. The recess is typically a substantially U-shaped recess but is shaped in order to receive the end portion of a louvre blade.

Normally, each side wall of the recess extends towards the louvre channel member from a respective outer wall. The recess has an end or base wall which is substantially parallel to the louvre channel member. The end or base wall may be provided with spacing means therein in order to prevent the louvre blade abutting the end or base wall. This will typically allow water to drain through the louvre end clip if required. Normally, one or more protrusions extend from the end or base wall to space the end edge of the louvre blade from the end or base wall.

Each louvre end clip includes at least one transverse opening therethrough, typically through at least one and normally both walls of at least the louvre blade recess. The at least one transverse opening is normally perpendicular to the louvre blade.

Preferably, the transverse opening is spaced from the end or base wall of the recess. Typically, at least one of the outer walls of the end clip also has an opening therethrough which is aligned with the transverse openings through the walls of the louvre blade recess.

Cover means may be provided in order to engage with the periphery of any opening in an outer wall in order to close the opening at least temporarily. The opposite outer wall may preferably be solid in order to provide a stop for the retention means although, openings may be provided in both the outer walls if desired. Stop means or a guide or receiving assembly may be provided on an inner surface of one of the outer walls in order to receive an end of the retention means to properly locate the retention means.

Preferably, any cover means is provided with a resiliently deformable portion to be deformably received into the opening in the outer wall of the louvre end clip. Gripping means may be provided on any cover means in order to allow removal.

Typically, the outer wall which is disposed to the outer side of the louvre window assembly is a solid wall and the opening is provided through the outer wall on the inner side of the louvre window assembly.

The retaining member will normally be a pin or similar. The retaining member may have any cross-sectional shape, be manufactured of any material, be solid or hollow, but will preferably be rigid and of high strength.

Normally, the retaining member will be dimensioned in order to be received between the outer walls of the louvre end clip. The retaining member may have gripping or attachment means to allow for removal of the retaining member when required. One end of the retaining member may be tapered in order to ease insertion of the retaining member and also to assist with alignment of the components through which the retaining means extends, during insertion.

The louvre window assembly will typically include a bearing mounting the louvre end clip to the louvre channel member. Typically, the bearing extends through the louvre channel and engages with a portion of the end clip. Normally, the bearing is provided with a pair of spaced apart walls between which are received the walls of the recess of the end clip, normally in an interference fit. This both attaches the end clip to the bearing which also locates the end clip relative to the channel member, but also allows the louvres to be opened and closed by rotation of the bearing causing similar rotation in the louvre end clip and louvre blade.

The bearing is preferably provided with at least one and normally a pair of openings, one through each of the respective spaced apart walls. The pair of openings is typically aligned with the transverse openings on the end clip and on the louvre blade in order to attach the louvre blade to the end clip and the end clip to the bearing at the same time.

Other components may be provided between the end clip and the bearing if required but if so, will preferably have at least one opening therethrough alignable with the openings in the bearing, end clip and louvre blade to receive the retaining member therethrough such that all components are fixed to one another and to the louvre blade by insertion of the retaining member.

The openings in the recess walls, the bearing and the louvre blade are preferably all dimensioned to closely receive the retaining member therein as this may minimise the amount of movement of the louvre blade relative to the end clip and bearing. This will typically minimise rattling.

Any of the features described herein can be combined in any combination with any one or more of the other features described herein within the scope of the invention.

BRIEF DESCRIPTION OF THE DRAWINGS

Various embodiments of the invention will be described with reference to the following drawings, in which.

DETAILED DESCRIPTION OF THE PREFERRED EMBODIMENT

According to a preferred embodiment of the present invention, a retention system for louvre blades is provided.

Figure 1:
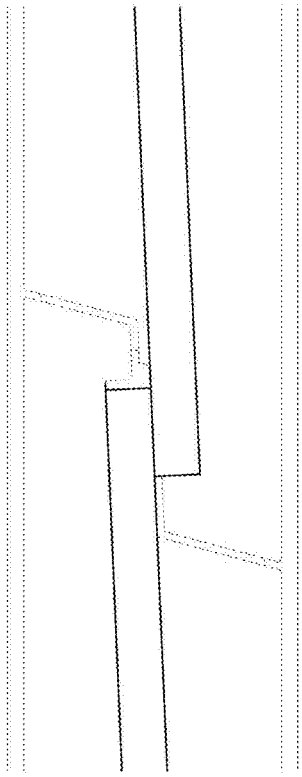
Figure 1 (Prior Art)
FIG. 1 is a sectional view of a prior art louvre window assembly showing overlapping blades and end clips.
Figure 2:
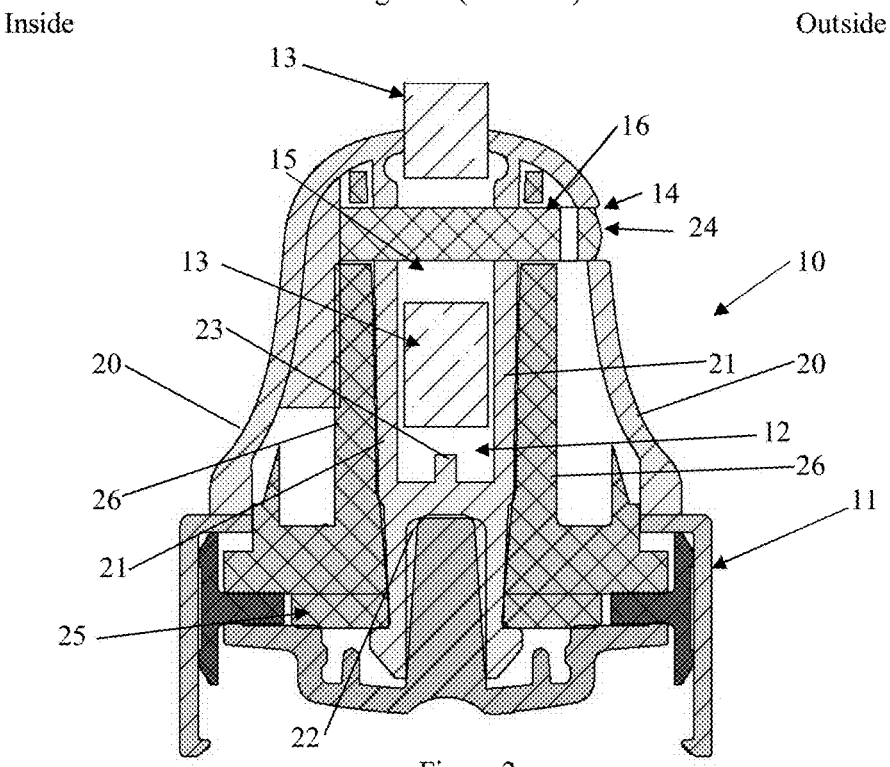
FIG. 2 is a sectional view along line A-A in FIG. 5 of a louvre blade, louvre end clip, bearing, and a portion of a louvre channel member according to a preferred embodiment of the present invention.
Figure 3:
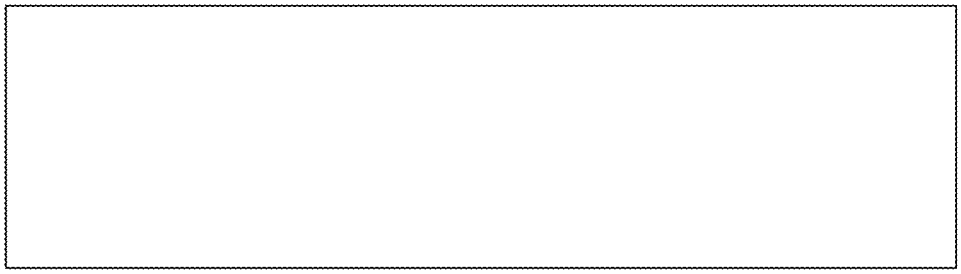
Figure 3 (Prior Art)
FIG. 3 is a top view of a conventional louvre blade.
Figure 4:
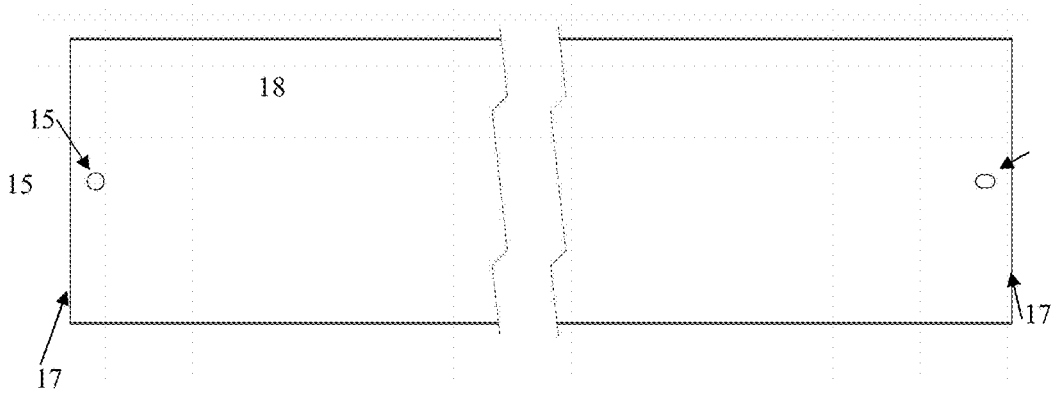
FIG. 4 is a top view of a louvre blade according to an aspect of the present invention.
Figure 5:
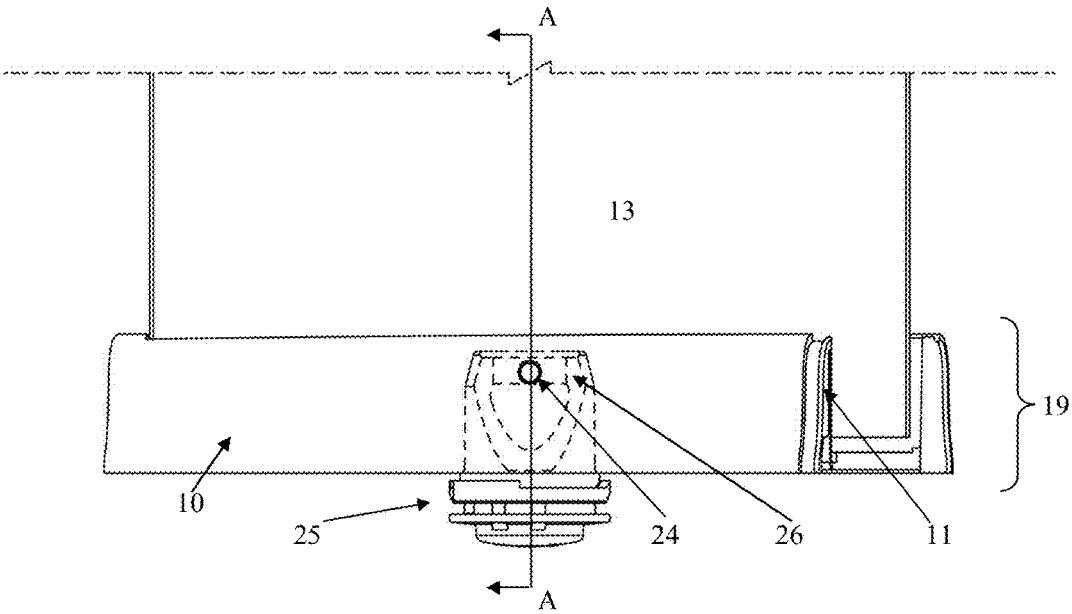
FIG. 5 is a view from above of a portion of the louvre window assembly of an aspect of the present invention showing the attachment of the louvre blade to the end clip and bearing.

The retention system illustrated in FIGS. 2, 4 and 5 includes a louvre end clip 10 mounted relative to a louvre channel 11. The louvre end clip 10 has a longitudinal recess 12 therein to receive an end portion of a louvre blade 13 and a transverse opening 14. The louvre blade 13 is also provided with an opening 15 therethrough in the end portion. In use, a retaining pin 16 is inserted through the aligned transverse opening 14 in the louvre end clip 10 and the opening 15 through the louvre blade 13 in order to fix the louvre blade 13 to the end clip 10.

The louvre blade 13 for use in a louvre window system having this retention system is as illustrated in FIG. 4. The illustrated louvre blade 13 has a pair of planar surfaces 18 and an opening 15 adjacent each end edge 17 extending through the louvre blade 13 from one planar surface 18 to the other.

There is an opening 15 in the louvre blade adjacent each end edge 17. Two alternative embodiments are illustrated in FIG. 4, namely one in which the opening 15 is circular (on the right end of the preferred embodiment) and an oval opening 15 with a longer dimension which extends toward the midline of the louvre blade (on the left). Each opening 15 is provided in a portion or region which is closer to the end edge 17 of the louvre blade 13 than the height of the longitudinal recess 12 in the end clip 10 as indicated by reference numeral 19 in FIG. 5.

Generally, each opening 15 is provided approximately centrally across the louvre blade.

In the most preferred form where the louvre blades 13 pivot about a central point, a single opening 15 is provided approximately midway across the height of each end of each louvre blade 13.

Each end clip 10 is located "inside" a louvre window frame which is normally defined by a louvre channel 11 on each side together with a head member (not shown) and a foot or sill member (not shown). According to the preferred embodiment of louvres which are moveable, each end clip 10 rotates relative to the louvre channel 11.

According to the preferred embodiment, each end clip 10 has a pair of outer walls 20 which each extend over the length or height of the end clip 10. The outer walls 20 extend from adjacent the channel member 11 towards the centre of the louvre blade 13, normally also extending inwardly towards the centre line of the louvre assembly. There is normally one outer wall on the outside of the louvre window assembly and one on the inside of the louvre window assembly.

The outer walls 20 may have any cross-sectional shape. The outer walls of adjacent louvre end clips align when closed to form a continuous sidewall.

Each louvre end clip 10 is located relative to the channel member 11 forming the louvre window frame. Each louvre channel member is normally substantially U-shaped in cross-section with an opening for each louvre blade to allow a louvre blade bearing 25 to extend therethrough.

The end clips may be removably fixed together, preferably with a press or snap fit connection. The connection between the end clip and the bearing may allow them to be assembled more easily and preferably without tools by sandwiching a portion of the channel between a portion of the end clip and a portion of the bearing.

The end clips 10 each have a longitudinal recess 12 formed between the respective outer walls 20. The longitudinal recess 12 of the illustrated embodiment is a substantially U-shaped recess shaped to receive the end portion of a louvre blade 13.

Each side wall 21 of the recess extends towards the louvre channel 11 member from a respective outer wall 20. The longitudinal recess 12 has an end or base wall 22 which is substantially parallel to the louvre channel member 11. The end or base wall 22 illustrated is provided with a spacing member 23 therein in order to prevent the end edge of the louvre blade 13 abutting the end or base wall 22. This allows water to drain through the louvre end clip 10 if required. Normally, one or more spacing members 23 are provided.

Each louvre end clip 10 includes at least one transverse opening 14 therethrough, typically through one of the recess side walls 21 and one of the outer walls 20. The transverse opening 14 is normally perpendicular to the louvre blade 13. In the embodiment illustrated, the transverse opening in the recess side wall and the transverse opening in the outer wall 20 are aligned and while the transverse opening extends through both the recess side walls 21, it only extends through one of the outer walls 20.

A cover member 24 may be provided in order to engage with the periphery of the opening in the outer wall 20 in order to close the opening 20 at least temporarily.

The preferred cover means 24 is provided with a resiliently deformable portion to be deformably received into the opening 14 in the outer wall 20 of the louvre end clip 10.

As illustrated, the outer wall 20 which is disposed to the outer side of the louvre window assembly is a solid wall and the opening 14 is provided through the outer wall 20 on the inner side of the louvre window assembly.

The retaining pin 16 may have any cross-sectional shape, the manufacture of any material, be solid or hollow but will preferably be rigid and of high strength.

The retaining pin 16 is dimensioned in order to be received between the respective outer walls 20 of the louvre end clip 10.

The louvre window assembly illustrated also includes a bearing 25 mounting the louvre end clip 10 to the louvre channel 11. Typically, the bearing 25 extends through the louvre channel 11 and engages with a portion of the end clip 10. Normally, the bearing 25 is provided with a pair of spaced apart walls 26 between which are received the side walls 21 of the recess of the end clip 10. This both attaches the end clip 10 to the bearing 25 which also locates the end clip 10 relative to the channel member 11 but also allows the louvre blades 13 to be opened and closed by rotational of the bearing 25 causing similar rotation in the louvre end clip 10 and louvre blade 13.

Each of the spaced apart walls 26 of the bearing 25 are provided with an opening. The openings are aligned with the transverse openings 14 on the end clip 10 and the opening 15 through the louvre blade 13 in order to attach the louvre blade 13 to the end clip 10 and the end clip 10 to the bearing 25 at the same time.

In the present specification and claims (if any), the word "comprising" and its derivatives including "comprises" and "comprise" include each of the stated integers but does not exclude the inclusion of one or more further integers.

Reference throughout this specification to "one embodiment" or "an embodiment" means that a particular feature, structure, or characteristic described in connection with the embodiment is included in at least one embodiment of the present invention. Thus, the appearance of the phrases "in one embodiment" or "in an embodiment" in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. A louvre blade retention system for use in a louvre windows system, the retention system including:

a. a louvre blade having two side surfaces and two end portions with at least one opening therethrough in each of the end portions;

b. a louvre end clip mounted relative to a louvre channel, the louvre end clip having at least one longitudinal recess therein defined by a pair of spaced apart side walls to receive at least one of the end portions of the louvre blade between the pair of spaced apart side walls and at least one transverse opening in each of the pair of spaced apart side walls, each at least one transverse opening defined by a periphery;

c. a bearing with a receiving channel to receive a part of the louvre end clip therein to mount the louvre end clip relative to a louvre window system surround frame, the receiving channel defined by a pair of spaced apart bearing side walls and at least one transverse bearing opening defined by a periphery in each of the pair of spaced apart bearing side walls; and d. a removable retaining pin adapted to be received through the aligned at least one transverse opening in the bearing, the at least one transverse opening in the spaced apart side walls of the louvre end clip and the at least one opening through the louvre blade in order to fix the louvre blade to the louvre end clip and to the bearing, wherein the retaining pin is received in the at least one transverse opening in each of the pair of spaced apart side walls in the louvre end clip, the retaining pin abutting the periphery of the at least one transverse opening in both of the pair of spaced apart side walls, and wherein the retaining pin is received in at least one transverse bearing opening in each of the pair of spaced apart bearing side walls, the transverse bearing opening being dimensioned to receive the retaining pin in both of the pair of spaced apart bearing side walls.

2. The louvre blade retention system as claimed in claim 1 wherein each end clip has a pair of outer walls extending from adjacent the louvre channel towards the centre of the louvre blade with the at least one longitudinal recess formed between the respective outer walls to receive the end portion of the louvre blade.

3. The louvre blade retention system as claimed in claim 2 wherein a single longitudinal recess with a pair of side walls is provided on each louvre end clip, each side wall extending towards the louvre channel from a respective outer wall, the longitudinal recess having an end or base wall which is substantially parallel to the louvre channel.

4. The louvre blade retention system as claimed in claim 3 wherein the end or base wall is provided with a spacer therein in order to prevent the louvre blade abutting the end or base wall.

5. The louvre blade retention system as claimed in claim 2 wherein the removable retaining pin is dimensioned in order to be received between the outer walls of the louvre end clip.

6. The louvre blade retention system as claimed in claim 1 wherein each louvre end clip includes at least one transverse opening through at least one wall of at least the at least one longitudinal recess.

7. The louvre blade retention system as claimed in claim 6 wherein the at least one transverse opening is substantially perpendicular to the louvre blade.

8. The louvre blade retention system as claimed in claim 6 wherein at least one outer wall of the end clip also has an opening therethrough which is aligned with the at least one transverse opening through at least one wall of at least the at least one longitudinal recess.

9. The louvre blade retention system as claimed in claim 8 wherein a cover is provided in order to engage with the periphery of any opening in an outer wall in order to close the opening at least temporarily.

10. The louvre blade retention system as claimed in claim 8 including a transverse opening through one outer wall only with the opposite outer wall is solid in order to provide a stop for the removable retaining pin.

11. The louvre blade retention system as claimed in claim 10 wherein the outer wall which is disposed to an outer, weather side of the louvre window assembly is a solid wall and the transverse opening is provided through the outer wall on an inner side opposite the outer, weather side of the louvre window assembly.

12. The louvre blade retention system as claimed in claim 1 wherein any opening to receive the removable retaining pin in an interference fit to minimise the amount of relative movement.

13. The louvre blade retention system as claimed in claim 1 wherein the removable retaining pin is an elongate pin.

14. The louvre blade retention system as claimed in claim 1 wherein the opening in the louvre blade is provided adjacent each end edge spaced from the end edge.

15. The louvre blade as claimed in claim 14 wherein each opening is provided approximately centrally across the louvre blade for pivoting louvres which pivot around a central point.

16. The louvre window system including:

a plurality of louvre blades wherein at least some of the louvre blades are mounted using a louvre blade retention system for use in a louvre windows system, the louvre blade retention system including:

a louvre blade having two side surfaces and two end portions with at least one opening therethrough in each of the end portions, a louvre end clip having at least one longitudinal recess therein defined by a pair of spaced apart side walls to receive at least one of the end portions of a louvre blade between the pair of spaced apart side walls and at least one transverse opening in each of the pair of spaced apart side walls, each at least one transverse opening defined by a periphery, a bearing member with a receiving channel to receive a part of the louvre end clip therein to mount the louvre end clip relative to a louvre window system surround frame, the receiving channel defined by a pair of spaced apart bearing side walls and at least one transverse bearing opening defined by a periphery in each of the pair of spaced apart bearing side walls and a removable retaining pin adapted to be received through the aligned at least one transverse opening in the bearing, the at least one transverse opening in the louvre end clip and the at least one opening through the louvre blade in order to fix the louvre blade to the louvre end clip and to the bearing wherein the retaining pin is received in the at least one transverse opening in each of the pair of spaced apart side walls in the louvre end clip, the retaining pin abutting the periphery of the at least one transverse opening in both of the pair of spaced apart side walls and wherein the retaining pin is received in at least one transverse bearing opening in each of the pair of spaced apart bearing side walls, the transverse bearing opening being dimensioned to receive the retaining pin in both of the pair of spaced apart bearing side walls.

17. The louvre blade retention system as claimed in claim 16 wherein the louvre window assembly includes a bearing mounting the louvre end clip to the louvre channel member, the bearing extending through the louvre channel and engaging with a portion of the end clip, the bearing provided with a pair of spaced apart walls between which are received the walls of the recess of the end clip to attach the end clip to the bearing which also locates the end clip relative to the channel member, and also allows the louvres to be opened and closed by rotation of the bearing causing similar rotation in the louvre end clip and louvre blade.

18. The louvre blade retention system as claimed in claim 17 wherein the bearing is provided with at least one opening, to align with the at least one transverse openings on the end clip and on the louvre blade in order to attach the louvre blade to the end clip and the end clip to the bearing at the same time.

* * * * *